US005410780A

United States Patent [19]

Silagy

[11] Patent Number: 5,410,780

[45] Date of Patent: May 2, 1995

[54] ROUND ROTATABLE BELT BUCKLE

[76] Inventor: Howard Silagy, 100A Tec St., Hicksville, N.Y. 11801

[21] Appl. No.: 243,417

[22] Filed: May 16, 1994

[51] Int. Cl.[6] ..... A44B 11/00

[52] U.S. Cl. ..... 24/168; 24/163 R; 24/163 K

[58] Field of Search ..... 24/168, 163 R, 163 K, 24/171, 180, 194, 186

[56] References Cited

U.S. PATENT DOCUMENTS 441,848 12/1890 Kemp ..... 24/168
721,411 2/1903 Alexander ..... 24/168
754,358 3/1904 Spohn ..... 24/168
2,855,650 10/1958 Cohen ..... 24/168
4,477,949 10/1984 Calabro ..... 24/180

FOREIGN PATENT DOCUMENTS 0015205 of 1885 United Kingdom ..... 24/168

*Primary Examiner*—Victor N. Sakran

[57] ABSTRACT

A belt buckle which screws down to engage a belt end necessarily requiring two degrees of movement, namely rotation and vertical descent, in which the belt-engaging member is confined to just the vertical descent incident to engagement of the belt surface being engaged so that this surface is not abraded or marred.

1 Claim, 3 Drawing Sheets

ROUND ROTATABLE BELT BUCKLE

The present invention relates generally to a belt buckle that engages and disengages from a decorative belt as a result of threadably produced descending and ascending movement of a belt-engaging operative member, and more particularly to improvements which obviate abrasion or marring of the decorative belt surface which is stationary incident to being engaged and the operative member which is partaking of rotative movement.

EXAMPLES OF THE PRIOR ART

There are currently in popular use belts of woven yarns embodying colors and positioned during weaving to provide a highly decorative display. A buckle of a well known type using a belt-engaging tongue would require intentional marring of the engaged belt end with spaced openings into which the tongue is projected into a selected opening to account for different waist sizes.

To obviate surface marring, tongue-receiving openings should, therefore, not be used. Cooperating clamps for opposite belt ends, as proposed in U.S. Pat. No. 754,358 issued to Spohn on Mar. 8, 1904 and U.S. Pat. No. 721,411 issued to Alexander on Feb. 24, 1903, thus call for clamps to be engaged to each other, and thus avoid clamp contact with the belt per se, but this solution is not entirely satisfactory in the obvious shortcoming that the resulting belt is not one in which "one size fits all".

Broadly, it is an object of the present invention to provide a decorative belt that is readily accommodated in encircling relation about different waist sizes overcoming the foregoing and other shortcomings of the prior art.

More particularly, it is an object to engage and disengage a belt end in the usual operating mode of a buckle, using a rotatable buckle component to this end, and without abrading or otherwise marring the decorative belt surface being engaged, all as will be explained in detail as the description proceeds.

The description of the invention which follows, together with the accompanying drawings should not be construed as limiting the invention to the example shown and described, because those skilled in the art to which this invention appertains will be able to devise other forms thereof within the ambit of the appended claims.

Figure 2:
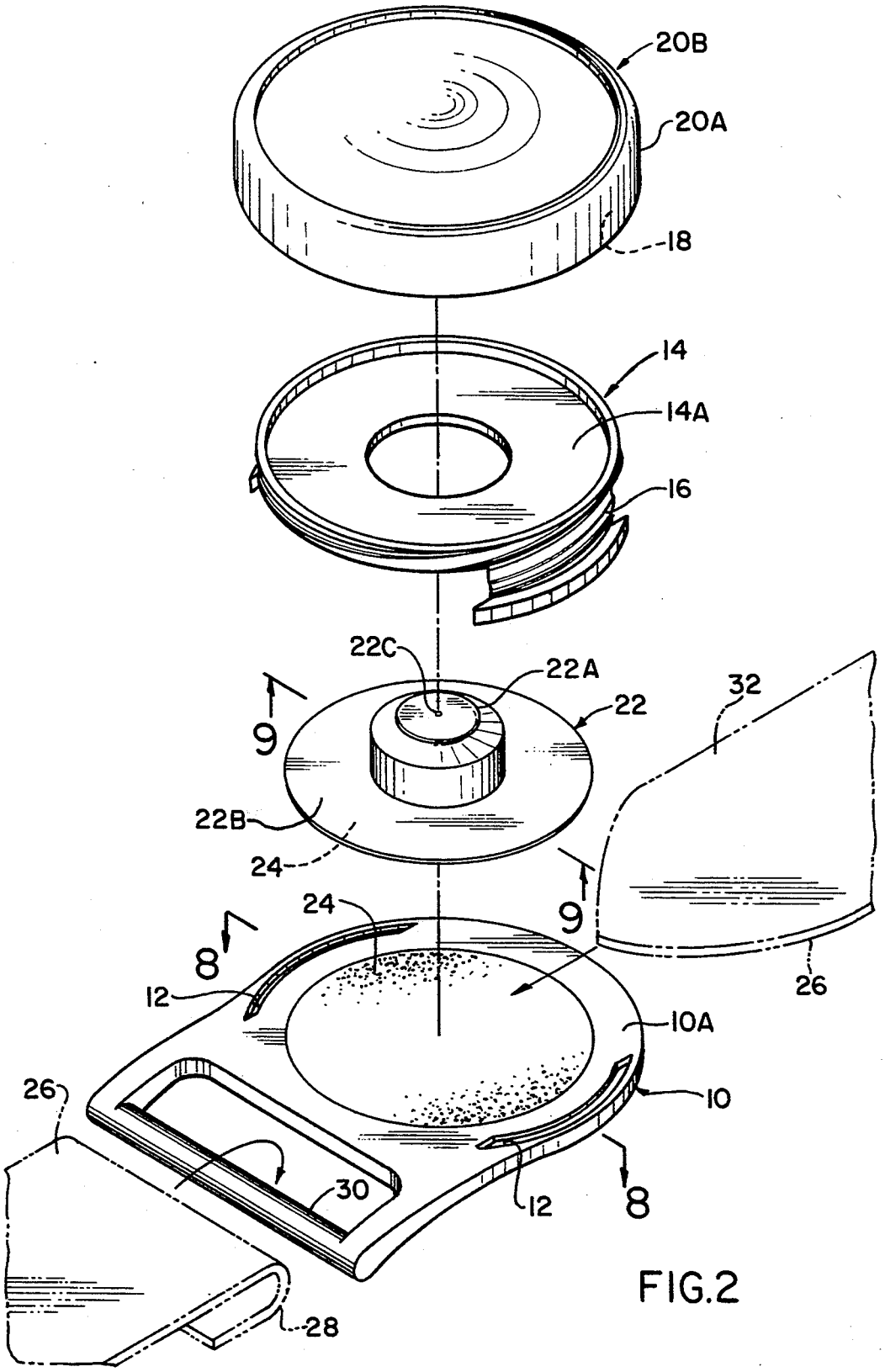
FIG. 2 is similarly a perspective view, but in exploded perspective with the buckle components in disassembled condition.
Figure 6:
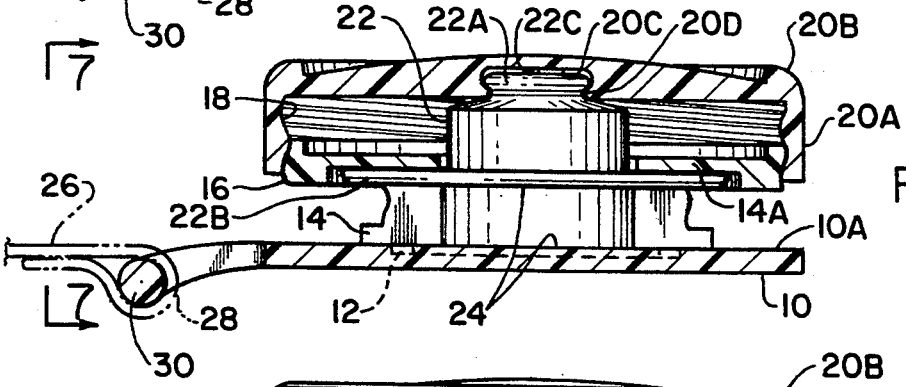
FIG. 6 is a cross sectional view similar to FIG. 5, but illustrating the unscrewed condition of the cap 20B preparatory to release of the belt.
Figure 7:
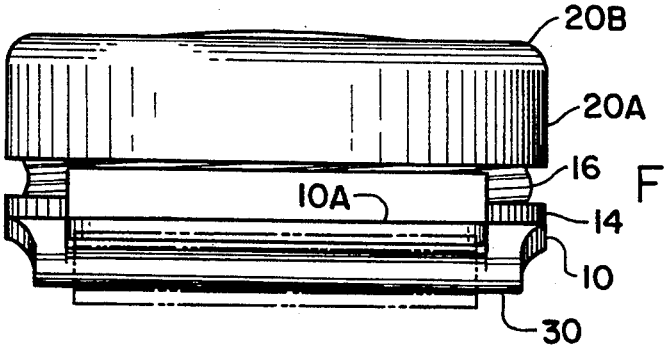
Figure 8:
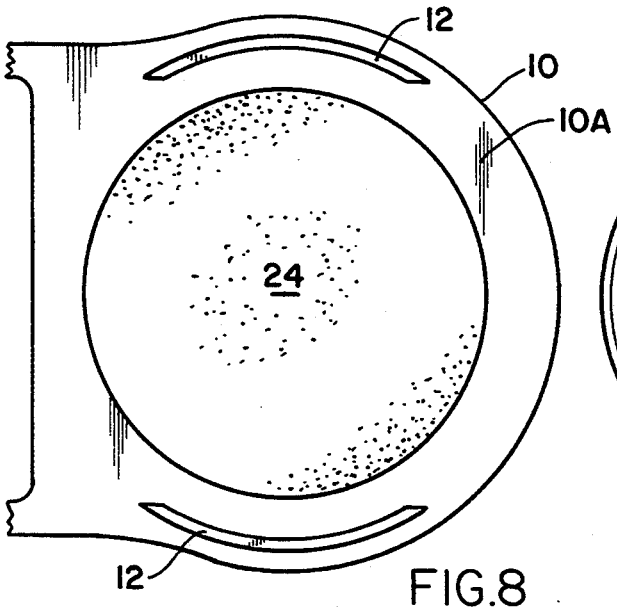
Figure 9:
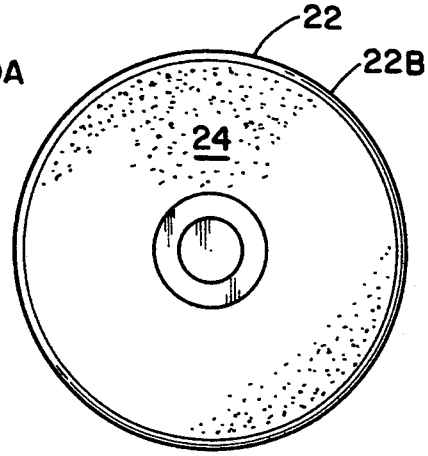

FIG. 7 is an end elevational view as seen widthwise of the belt and taken along line 7—7 of FIG. 6; and FIG. 8 and FIG. 9 are plan views respectively taken along lines 8 and 9 of FIG. 2.

Figure 1:
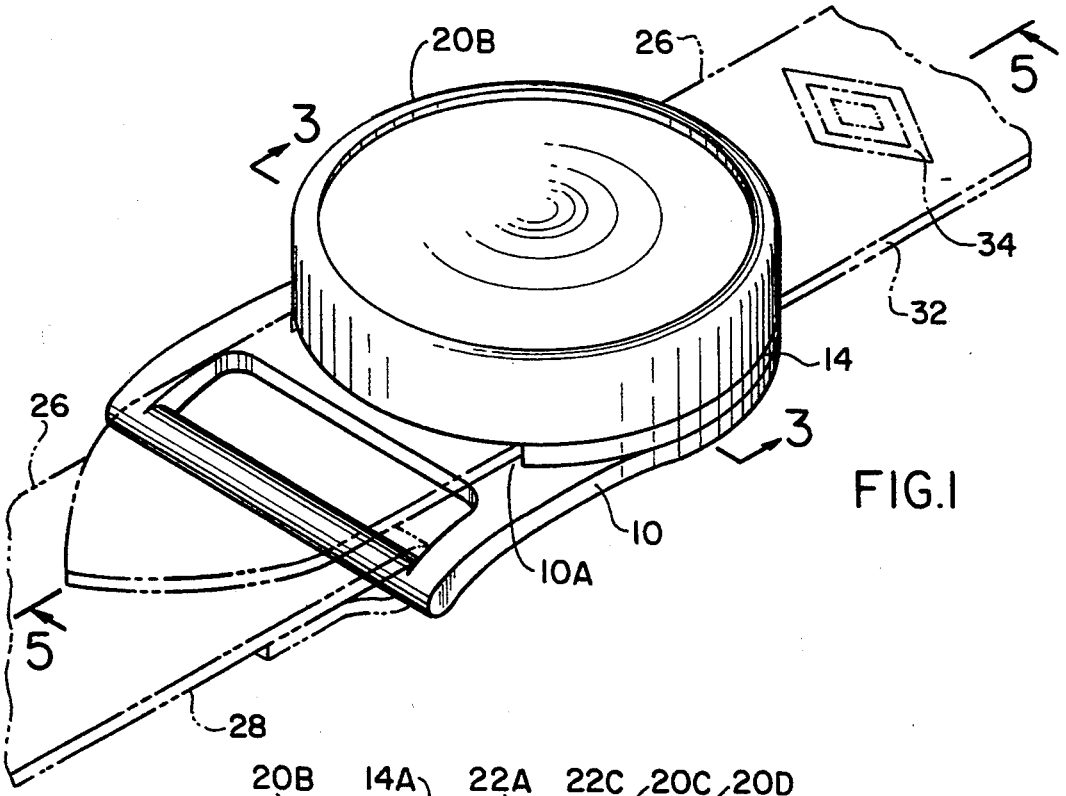
FIG. 1 is a perspective view of the within inventive round rotatable belt buckle in assembled condition and with said cap 20B screwed down to cause the engagement of the cooperating belt end 32 shown in phantom perspective.
Figure 3:
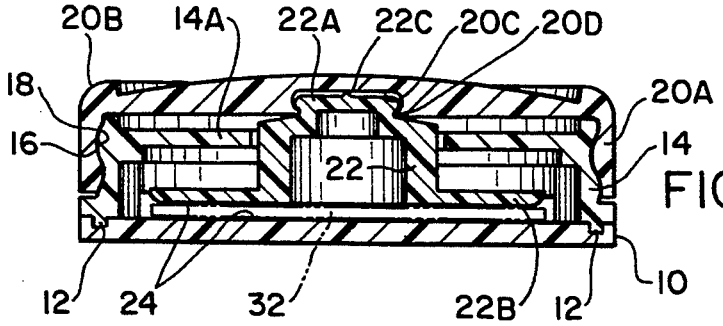
FIG. 3 is a cross sectional view taken along line 3—3 of FIG. 1 and as seen widthwise of the belt.
Figure 4:
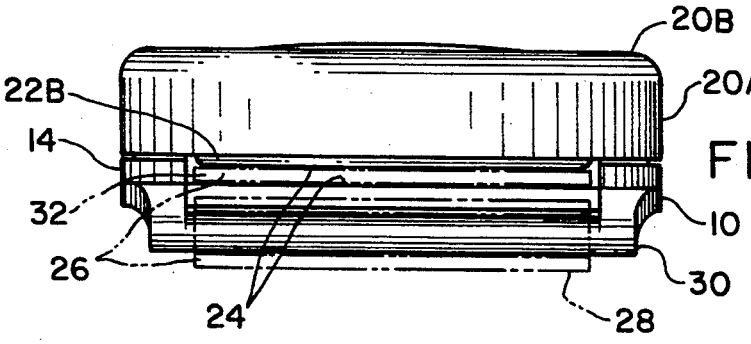
FIG. 4 is a cross sectional view taken in the same perspective to the buckle as FIG. 3 but taken along line 4—4 of FIG. 5.
Figure 5:
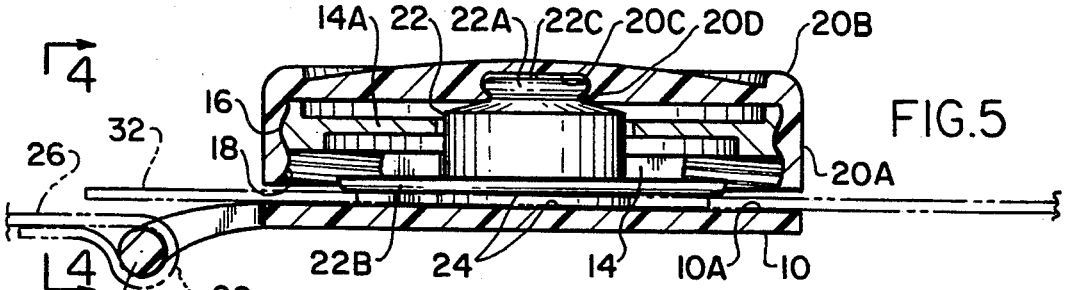
FIG. 5 is a cross sectional view taken along line 5—5 of FIG. 1.

The within inventive buckle, the components parts of which are shown in phantom perspective in FIG. 2, is of a round configuration featuring a round external cap 20B having an operating mode in which it is screwed down to engage a cooperating belt end 32 as best shown in FIGS. 1 and 5, and unscrewed to release this belt end, as best shown in FIG. 6 and FIG. 7 projected therefrom. This simple rotatable screw cap 20B-operated buckle is intended specifically for advantageous use with a highly decorative belt 26, the surface decoration embodied in the construction of the belt being exemplified by the design emblem 34 (FIG. 1). In this regard, underlying the present invention is the recognition that the belt end 32 during normal use of the within, or any other buckle, is engaged and released many, many times, and during each engagement the lengthwise pulling force exerted on the belt contributes to abrasion which, in turn, defaces or mars the belt surface decoration 34. It is undoubtedly for this reason that a buckle of the type using a belt-engaging tongue is in popular use, but such buckle is not entirely satisfactory since the belt end must be intentionally provided with, and thus nominally defaced by, spaced tongue-receiving openings to account for different waist sizes. It is thus provided in the operating mode of the within inventive buckle to obviate, during screw-down cap 20B engagement of the belt end 32, any surface abrading while nevertheless achieving firm engagement of the belt end, all as will now be explained in detail.

Shown in phantom perspective in FIGS. 1–6 is a belt 26 of woven web construction in which, in a well understood manner, the woven yarns embody colors and design positions which result in a highly decorative surface display 34. Belt 26 has an end loop 28 permanently secured as by rivets, sewing, or the like, about a bar-like support 30 (FIG. 2) extending from one end of the buckle base 10. Spot welded or attached with a friction snap fit or other appropriate technique at location 12 on base 10 is a cylindrical housing 14 having external threads 16. Threadably engaged to the threads 16 are cooperating threads 18 of a cylindrical wall 20A of a cap 20B.

Extending in depending relation from a central cap opening 20C bounded by an edge 20D in which there is a snap-in friction fit past said edge is the top 22A of an operable member 22 adapted, when urged through descending movement by rotation of the cap 20B, to close against the belt end 32. More particularly, and as may be best understood from FIG. 2 and the plan views of FIGS. 8 and 9 projected therefrom, member 22 has a disc 22B formed integral thereon presenting a friction surface 24 in facing relation to a similar friction surface 24 in the descending path of movement of member 22, so as to engage the previously positioned belt end 32 therebetween, the length of the belt end being, of course, a function of the waist size of the user.

Internal housing 14 threadably cooperating with the screw cap 20B is supported on the base surface 10A only alongside projections into cooperating slots 12, as best shown in FIG. 2, so that belt 26, and more particularly belt end 32, can be inserted in the direction of the illustrated arrow into an interposed position between the surfaces 24 preparatory to engagement upon descending movement the assembly of the member 22 and cap 20B.

At the instance of the initial contact of upper friction surface 24 with the belt end 32 there is, of course, resistance to rotative movement since the belt end 32 does not have a rotative degree of movement. If this initial contact force was excessive and continued to be applied it would result in undesirable abrading of the belt surface decoration 34. Thus, in accordance with the present invention, the rotative directional urgency of the applied force is relieved by member 22 remaining in a non-rotating condition and only the cap 20B continuing to partake of rotation within the cap opening 20C, aided by a nipple 22C which reduces friction by creating a clearance between upper surface 22A and the opening surface 20C. Continued screw-down adjustment of cap 20B is continued until the belt end 32 is firmly engaged against being pulled loose of the buckle, and occurs without abrading of the belt 26 since the belt-engaging surface 24 of member 22 does not rotate but tracks only in a vertical path. It should likewise be readily understood that unscrewing of cap 20B is occasioned without rotation of member 22 during initial ascending movement thereof, and thus not until there is physical disengagement of surface 24 from the belt end 32.

While the belt buckle embodiment herein shown and disclosed in detail is fully capable of attaining the objects and providing the advantages hereinbefore stated, it is to be understood that it is merely illustrative of the invention and that no limitations are intended to the detail of construction or design herein shown other than as defined in the appended claims.

What is claimed is:

1. A round rotatable belt buckle in the use of which a surface-decorated belt with opposite ends and in encircling relation about a user has said one opposite end attached thereto and said other opposite end adapted to be selectively engaged thereby, said buckle comprising a housing base, an internal housing member of an inverted U-shape in cross section consisting of an externally threaded circular side wall and a horizontally oriented top wall with a central opening therein attached to said housing base to define therebetween a passageway for receiving in projected relation therethrough said belt end to be engaged, a rotatable cap of a U-shape in cross section consisting of a circular internally threaded side wall and a horizontally oriented top wall threadably engaged in covering relation over said internal housing member by said external and internal threads of said side walls thereof, and a belt-engaging member frictionally rotatably attached in depending relation from said cap to extend through said central opening of said internal housing member into said passageway and having a belt-engaging surface in facing relation to said housing base, whereby rotation of said cap is adapted to urge said belt-engaging surface into descending closing and ascending opening movement in relation to a belt end positioned on said housing base and upon closing movement resulting in engagement therewith such that the frictional engagement between said cap and said belt-engaging member is exceeded and any rotation of said belt-engaging member obviated so as to correspondingly obviate any abrading of the engaged belt surface as might otherwise be caused by such rotation.

* * * * *